US009849332B1

(12) United States Patent
Huang et al.

(10) Patent No.: US 9,849,332 B1
(45) Date of Patent: Dec. 26, 2017

(54) EXERCISE DEVICE

(71) Applicant: Dyaco International Inc., Taipei (TW)

(72) Inventors: Hsuan-Fu Huang, Taipei (TW); Han-Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 0 days.

(21) Appl. No.: 15/275,141

(22) Filed: Sep. 23, 2016

(30) Foreign Application Priority Data

Sep. 8, 2016 (TW) ..... 105129183 A

(51) Int. Cl.

| | |
|---|---|
| ***A63B 22/06*** | (2006.01) |
| ***A63B 21/22*** | (2006.01) |
| ***A63B 21/00*** | (2006.01) |
| ***A63B 22/00*** | (2006.01) |
| ***A63B 23/035*** | (2006.01) |

(52) U.S. Cl.
CPC ..... *A63B 22/0664* (2013.01); *A63B 21/225* (2013.01); *A63B 21/4034* (2015.10); *A63B 21/4035* (2015.10); *A63B 22/001* (2013.01); *A63B 23/03575* (2013.01); *A63B 2022/0676* (2013.01)

(58) Field of Classification Search
CPC ..... A63B 22/0064; A63B 21/4034; A63B 21/4035; A63B 21/225; A63B 22/001; A63B 23/03575; A63B 2022/0676
USPC ..... 482/52
See application file for complete search history.

(56) References Cited

U.S. PATENT DOCUMENTS

| | | | | |
|---|---|---|---|---|
| 6,024,676 | A * | 2/2000 | Eschenbach | A63B 22/001 482/51 |
| 6,422,976 | B1 * | 7/2002 | Eschenbach | A63B 22/001 482/51 |
| 9,186,541 | B1 * | 11/2015 | Murray | A63B 22/201 |
| 2009/0239715 | A1 * | 9/2009 | Nelson | A63B 22/001 482/52 |
| 2010/0167880 | A1 * | 7/2010 | Long | A63B 22/001 482/52 |
| 2010/0317492 | A1 * | 12/2010 | Nelson | A63B 22/0664 482/52 |
| 2011/0294627 | A1 | 12/2011 | Lai | |
| 2012/0077645 | A1 * | 3/2012 | Lee | A63B 22/001 482/52 |
| 2015/0087481 | A1 * | 3/2015 | Liu | A63B 22/0664 482/52 |
| 2015/0182787 | A1 * | 7/2015 | Liu | A63B 22/001 482/52 |

(Continued)

FOREIGN PATENT DOCUMENTS

DE 202015104469 U1 10/2015

OTHER PUBLICATIONS

Extended European Search Report dated Oct. 25, 2017 in related European Application No. 17159682.8.

*Primary Examiner* — Andrew S Lo
(74) *Attorney, Agent, or Firm* — Donald E. Stout; Stout, Uxa & Buyan, LLP

(57) ABSTRACT

An exercise device comprises a frame, two first swing arms, two second swing arms, two pedals, a resistance device, two cranks, two link rods, two limiting rods, and two upper linking assemblies. By arrangement of the above components, the moving path of each pedal can be an elliptical path. In some embodiment, an angle-adjustment device is used to adjust the slope of the elliptical moving path.

13 Claims, 18 Drawing Sheets

(56) References Cited

U.S. PATENT DOCUMENTS

| | | | | |
|---|---|---|---|---|
| 2016/0213970 | A1 | 7/2016 | Eschenbach | |
| 2017/0189743 | A1* | 7/2017 | Smith | A63B 22/0015 |

* cited by examiner

4

7

7

EXERCISE DEVICE

CROSS-REFERENCE TO RELATED APPLICATIONS

The entire contents of Taiwan Patent Application No. 105129183, filed on Sep. 8, 2016, from which this application claims priority, are expressly incorporated herein by reference.

BACKGROUND OF THE INVENTION

1. Field of the Invention

The present invention relates to an exercise device, and more particularly relates to an exercise device providing ergonomic paths and variable strides.

2. Description of Related Art

Without limiting the disclosed embodiments, a stair stepper, is an exercise device to elevate the heart rate, burn calories and improve cardiovascular endurance.

On a typical stair stepper, a user stands on two platforms supported by a given level of resistance. The user lifts alternating feet, as if walking up a set of stairs, so as to build muscle in legs and gluteus. The stair stepper is also a lower-impact training machine compared to a treadmill, making it useful for those with leg injuries. However, the stair stepper should be used with caution because inadequately activating will place additional stress on the knees.

FIG. 1A and FIG. 1B show two conventional stair steppers. FIG. 1A shows a convention stair stepper with an axis 21 and a pedal 20 coupling with the axis 21 via a rod 22, so that the pedal 20 moves along a path P. FIG. 1B shows another conventional stair stepper with two axis 21 and a pedal 20 coupling with the two axis 21 via two rods 22, so that the pedal 20 moves along a path P. Noticed that the both paths P are an arc with a center pointing away the user, and the paths P are not ergonomic and thus cannot simulate the real stepping, striding, or stair-climbing.

US patent US20120077645 discloses a stair stepper, in which the crank arm exerts force to the linking units, so that the pedal link coupled with the linking units can be moved forward and backward. Each pedal link has a rollable anti-friction member to pivotally couple with the pedal. When the pedal link is moved forward, the rollable anti-friction member drags the pedal climbing forwardly and upwardly along the ramp rod. However, the climbing force of the pedals is unsufficient, and thus the design is not a good solution to simulate stepping, striding, or stair-climbing.

The detail of conventional steppers can also refer to Taiwan patent 1458519, entitled "adjustable stepper," and Taiwan patent 1442955, entitled "stepper," the entire contents of the foregoing applications are incorporated herein for reference.

In addition, conventional steppers typically suffer from a "dead point" problem. The dead point is a point that when a crank and a link of a linking mechanism are operated to be overlapped, it is difficult to further move the crank.

SUMMARY OF THE INVENTION

In one general aspect, the present invention relates to an exercise device having ergonomic paths and variable strides and being designed to overcome the "dead point" problem.

In an embodiment of the present invention, an exercise device is provided with a frame, two first swing arms, two second swing arms, two pedals, a resistance, two cranks, two link rods, two limiting rods, and two upper linking assemblies. The frame includes a base and a supporting structure, wherein the base is arranged on a supporting plane or ground and the supporting structure is arranged on the base. The two first swing arms are respectively arranged at a left side and a right side of the supporting structure, and each first swing arm has a first end pivotally coupling with the supporting structure. The two second swing arms couple with the two first swing arms, and each first swing arm has a second end pivotally coupling with a first end of one corresponded second swing arm. The two pedals couple with the two second swing arms, and each second swing arm has a second end coupling with one corresponded pedal. The resistance device is mounted on the supporting structure and has a driving wheel with an axle for providing a resistance. The two cranks are respectively arranged at a left side and a right side of the resistance device, and each crank has a first end coupling with the axle of the driving wheel. The two link rods couple with the two cranks and the two second swing arms, each link rod pivotally coupling to one corresponding second swing arm via a pivot, each link rod having a first end to couple a second end of one corresponded crank. The two limiting rods movably couple to two link rods, each limiting rod having an end pivotally coupling with the base, each link rod having a second end with a roller to slide on one corresponding limiting rod. The two upper linking assemblies are respectively arranged at a left side and a right side of the supporting structure, each upper linking assembly having an end with a handle to be held by a user and having another end pivotally coupling to the first end of one corresponding link rod or pivotally coupling to a portion between the first end and the second end of one corresponding link rod. Accordingly, each pedal has an elliptical moving path.

In an embodiment, an angle between a major axis of the elliptical moving path and a horizontal plane is greater than 40°.

In an embodiment, each second swing arm further comprising a connecting member to couple with the corresponding link rod, and the pivot of the second swing arm is at an upper end of the connecting member, so that a distance is between the pivot and the second swing arm.

In an embodiment, each upper linking assembly comprises an upper rod, a first linking arm, and a second linking arm, and wherein a first end of the upper rod has the handle to be held by the user, a second end of the upper rod couples to the first linking arm, a first end of the first linking arm pivotally couples to the supporting structure via a pivot, a second end of the first linking arm pivotally couples to a first end of the second linking arm, and a second end of the second linking arm pivotally couples to the first end of one corresponding link rod or pivotally couples to a portion between the first end and the second end of one corresponding link rod.

In an embodiment, each upper linking assembly comprises an upper rod, a first linking arm, a second linking arm, a third linking arm, a fourth linking arm, and a transporting member, and wherein a first end of the upper rod includes the handle to be held by the user, a second end of the upper rod couples with the first linking arm, a first end of the first linking arm pivotally couples to the supporting structure via a pivot, a second end of the first linking arm pivotally couples to a first end of the second linking arm, a second end of the second linking arm pivotally couples to a first end of the transporting member, a first end of the third linking arm pivotally couples to the supporting structure via a pivot, a second end of the third linking arm couples to a side of the transporting member, a first end of the fourth linking arm pivotally couples to a second end of the transporting member, and a second end of the fourth linking arm pivotally couples to the first end of one corresponding link rod.

In an embodiment, the exercise device further comprises an angle-adjustment device to movably couple a first end of each of the two limiting rods, and a second end of each of the two limiting rods pivotally couples to the base.

In an embodiment, the angle-adjustment device comprises a motor, a screw, and a tube, the tube has internal thread to engage with the screw, and the motor can drive the screw to rotate, so that the tube is moved along the screw in a direction toward the motor or away from the motor.

In an embodiment, an end of the motor pivotally couples to the base, an end of the tube couples to a horizontal linkage, and the first end of each of the two limiting rods couples to the horizontal linkage.

In an embodiment, the angle-adjustment device is a manually controlled device and comprises an inner tube, an outer tube, a controller, and a support, and wherein the inner tube is arranged within the outer tube, an end of the outer tube pivotally couples to the base, an end of the inner tube movably couples to the first end of each of the two limiting rods, the controller couples to the support and the controller can be manually placed into one of a plurality of positioning recesses of the outer tube, and the support couples to the inner tube and can drag the inner tube moving within the outer tube.

In an embodiment, each limiting rod is arc-shaped with a center toward a portion of the user.

DETAILED DESCRIPTION OF THE PREFERRED EMBODIMENT

Figure 1A:
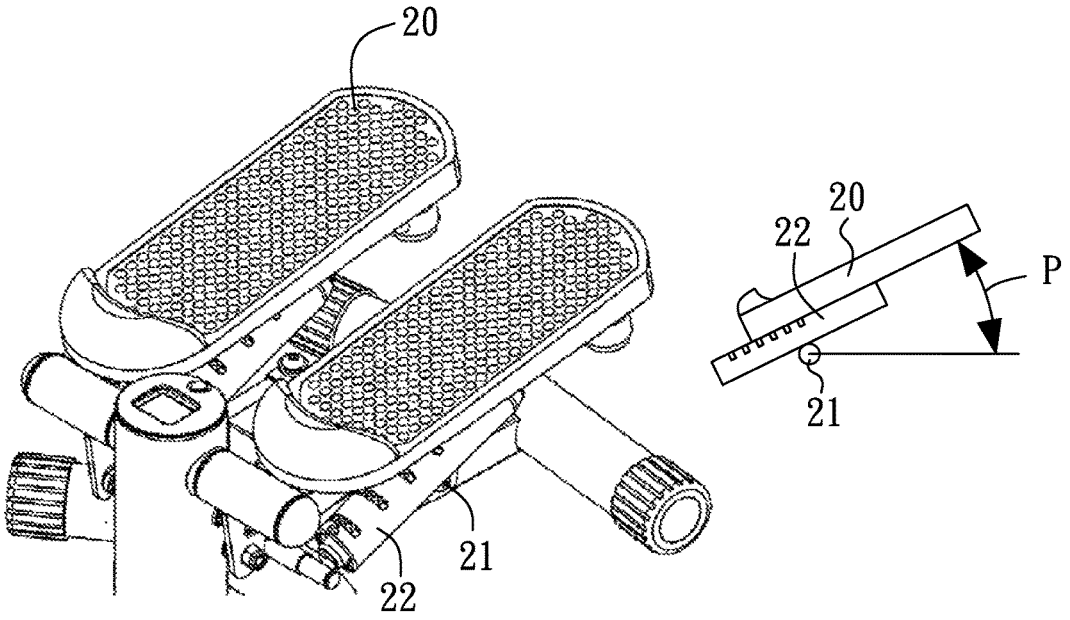
FIG.1A (PRIOR ART)
FIGS. 1A and 1B show two conventional stair steppers and their moving paths.
Figure 1B:
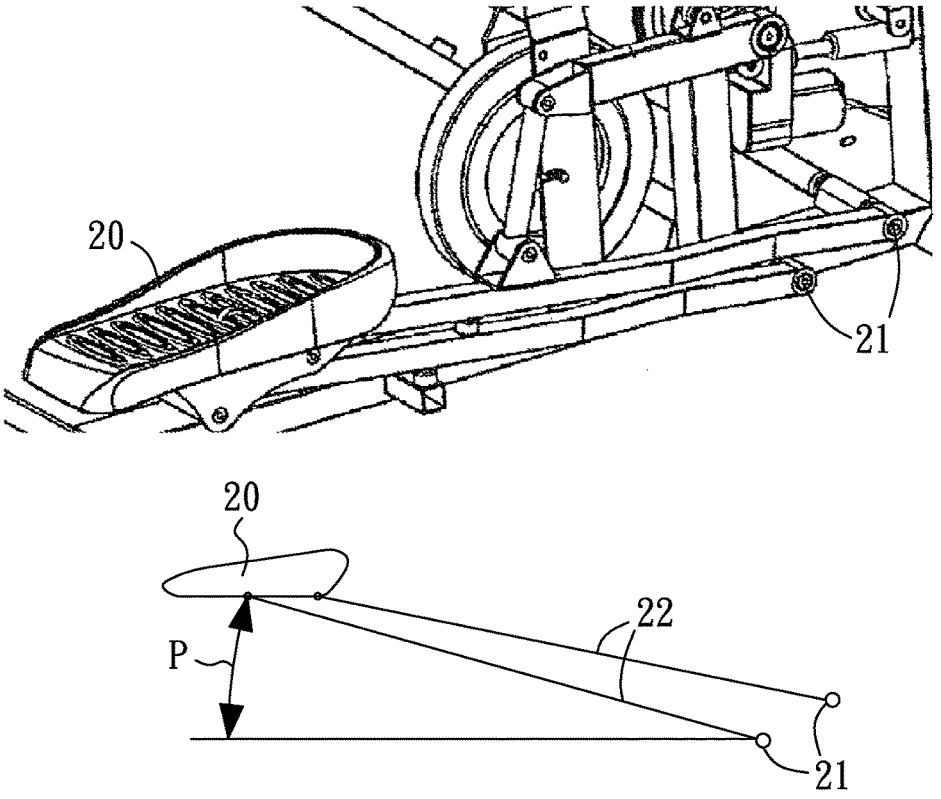
FIG.1B (PRIOR ART)

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
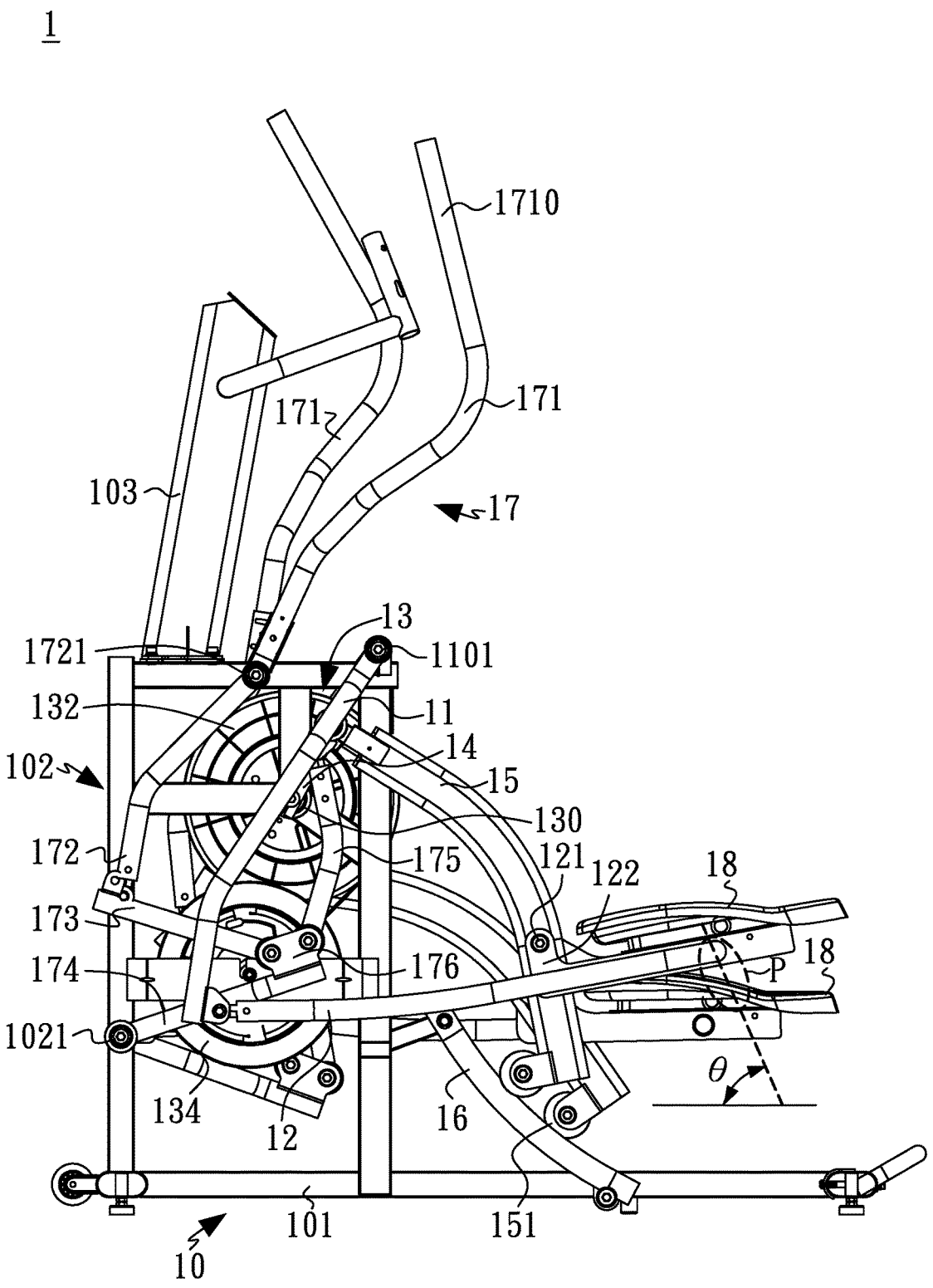
FIG. 2 is a side view showing an exercise device according to a first embodiment of the present invention.
Figure 3:
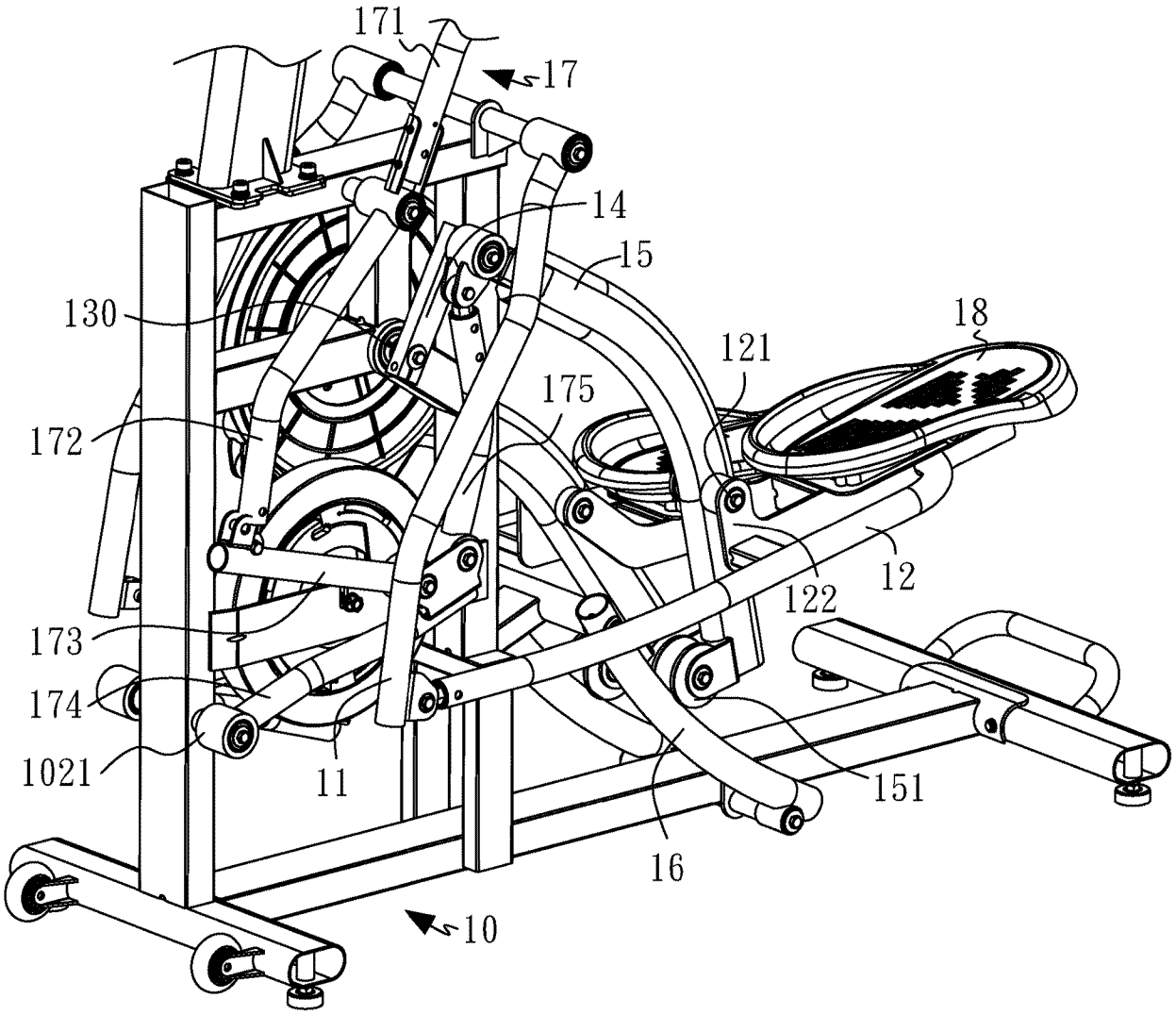
FIG. 3 is a partially perspective view showing the exercise device according to the first embodiment of the present invention.

FIGS. 2 and 3 are side and partially perspective view, respectively, showing an exercise device 1 according to a first embodiment of the present invention. The exercise device 1 comprises a frame 10, two first swing arms 11, two second swing arms 12, a resistance device 13, two cranks 14, two link rods 15, two limiting rods 16, two upper linking assemblies 17, and two pedals 18. Referring to FIGS. 2 and 3, preferably the frame 10 may comprise, but is not limited to, a base 101 and a supporting structure 102. The base 101 is placed on a supporting plane or ground. The supporting structure 102 is arranged on the base 101. Both the two first swing arms 11 and the two second swing anus 12 are arranged at a left side and a right side of the frame 10, respectively. Each first swing arm 11 and each second swing atm 12 include two ends, a first end and a second end, in which the first end of the first swing atm 11 pivotally couples with the supporting structure 102 via a pivot 1101, and the second end of the first swing arm 11 pivotally couples with the first end of one corresponded second swing arm 12. And the second end of the corresponded second swing arm 12 couples with one corresponded pedal 18. Without limiting the scope of the present invention, a post 103 may be arranged on the supporting structure 102, in which one end of the post 103 couples with the supporting structure 102, and the other end of the post 103 couples with an operating interface (not shown) allowing the user to control the exercise device 1.

Referring to FIGS. 2 and 3, the two cranks 14 are respectively arranged at a left side and a right side of the resistance device 13. The resistance device 13 comprises a driving wheel 132 with an axle 130, and each crank 14 and each link rod 15 include two ends, a first end and a second end. The first end of each crank 14 couples with the axle 130, and the second end of each crank 14 pivotally couples with the first end of one corresponding link rod 15. And the second end of the corresponding link rod 15 includes a roller 151. In addition, each second swing arm 12 pivotally couples with one corresponding link rod 15 via a pivot 121. For example, each second swing arm 12 includes a connecting member 122 and the pivot 121 is at an upper end of the connecting member 122. Accordingly, a distance, e.g., 8-20 cm, is between the pivot 121 and the second swing arm 12.

Referring to FIGS. 2 and 3, the two limiting rods 16 movably couples with the two link rods 15, respectively. In this embodiment, each limiting rod 16 includes a first end to couple with the supporting structure 102 and includes a second end to couple with the base 101, and the second end of each link rod 15 includes the roller 151 that can slide forward and backward on one corresponding limiting rod 16. Preferably, each limiting rod 16 is arc-shaped with a center toward a portion of a user, e.g., foot or shank of the user.

Referring to FIGS. 2 and 3, the two upper linking assemblies 17 are respectively arranged at a left side and a right side of the supporting structure 102 and couples with the two link rods 15. Each upper linking assembly 17 may comprise, but is not limited to, an upper rod 171, a first linking arm 172, a second linking arm 173, a third linking arm 174, a fourth linking arm 175, and a transporting member 176. A first end of the upper rod 171 includes a handle 1710 to be held by the user, and a second end of the upper rod 171 couples with the first linking arm 172. A first end of the first linking arm 172 pivotally couples to the supporting structure 102 via a pivot 1721, and a second end of the first linking atm 172 pivotally couples with a first end of the second linking arm 173. A second end of the second linking arm 173 pivotally couples to a first end of the transporting member 176. A first end of the third linking arm 174 pivotally couples to the supporting structure 102 via a pivot 1021, and a second end of the third linking arm 174 couples to a side of the transporting member 176. A first end of the fourth linking arm 175 pivotally couples to a second end of the transporting member 176, and a second end of the fourth linking arm 175 pivotally couples to the first end of one corresponding link rod 15.

Referring to FIGS. 2 and 3, when a user stands on two pedals 18, a resistance is given by the resistance device 13. The operating interface (not shown) mounted on the post 103 can determine the resistance. In this embodiment, the resistance device 13 may further include a flywheel 134 in addition to the driving wheel 132. The driving wheel 132 has the axle 130 with bidirectional bearing (not shown) coupling with the first end of the two cranks 14. The motion of the pedals 18 will drive the driving wheel 132, which then drives the flywheel 134 to rotate.

Referring to FIGS. 2 and 3, the exercise device 1 has the above-mentioned mechanism such that a moving path P of the pedals 18 is an elliptical or substantially elliptical shaped, which differs from the conventional steppers. In addition, an angle θ is between a major axis of the elliptical moving path of each pedal 18 and the horizontal plane, and the angle θ is greater than 40°, according to some embodiments of the present invention. In some embodiments of the present invention, the angle θ is between 40° and 65°. According to some other embodiments of the present invention, the angle θ is greater than 50°, or, the angle θ is between 45° and 70°.

Figure 4:
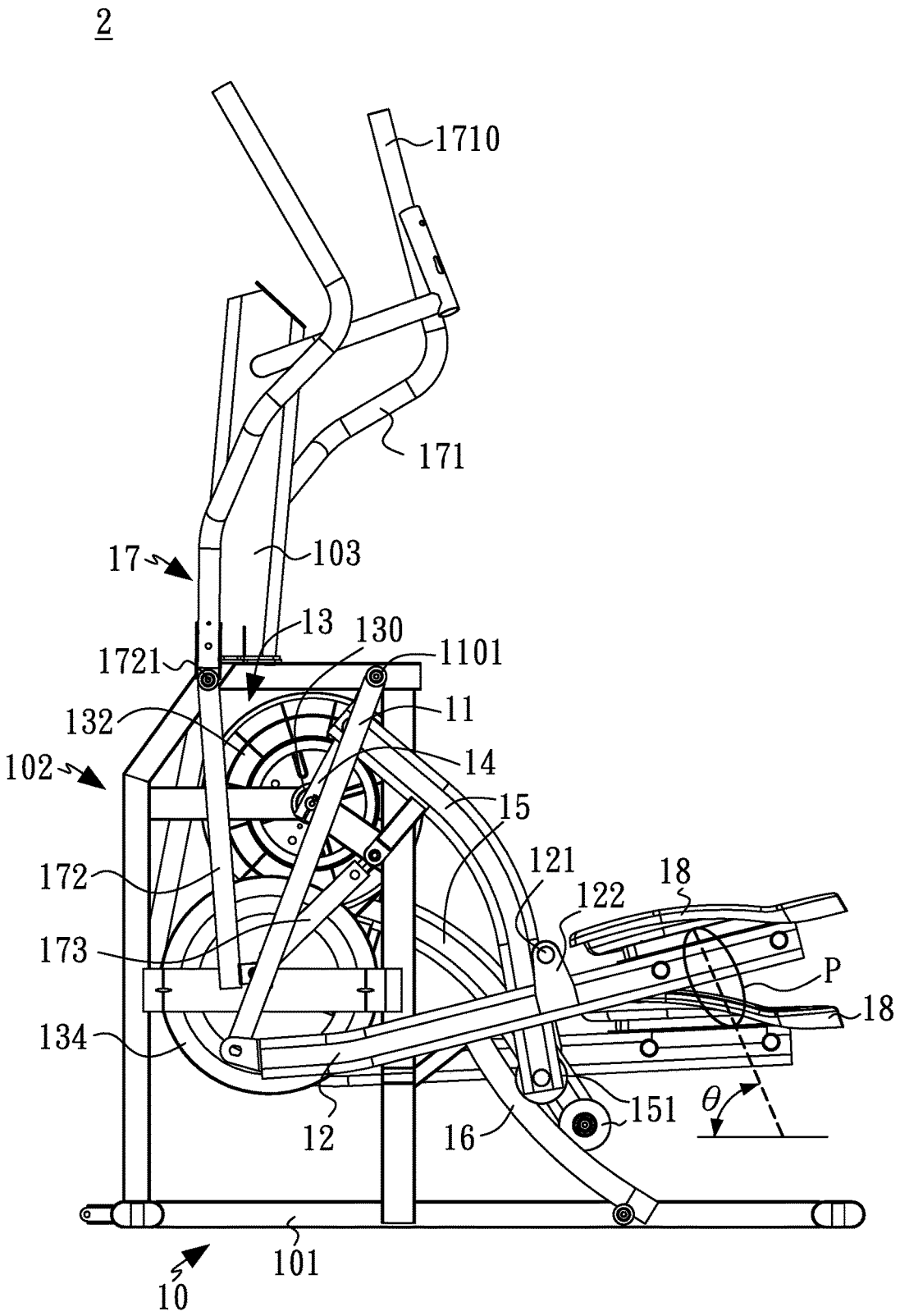
FIG. 4 is a side view showing an exercise device according to a second embodiment of the present invention.

FIG. 4 is a side view showing an exercise device 2 according to a second embodiment of the present invention. The second embodiment differs from the first embodiment in that each upper linking assembly 17 merely includes the upper rod 171, the first linking arm 172, and the second linking arm 173, and omits the third linking arm 174, the fourth linking arm 175, and the transporting member 176. In addition, the first end of the second linking atm 173 pivotally couples to the second end of the first linking arm 172, and the second end of the second linking arm 173 pivotally couples to a portion between the first end and the second end of one corresponding link rod 15, e.g., coupling to the front one-third portion of the corresponding link rod 15. In addition, the connecting member 122 of the exercise device 2 has an outline slightly different from but the same function as the connecting member 122 of the exercise device 1.

Figure 5:
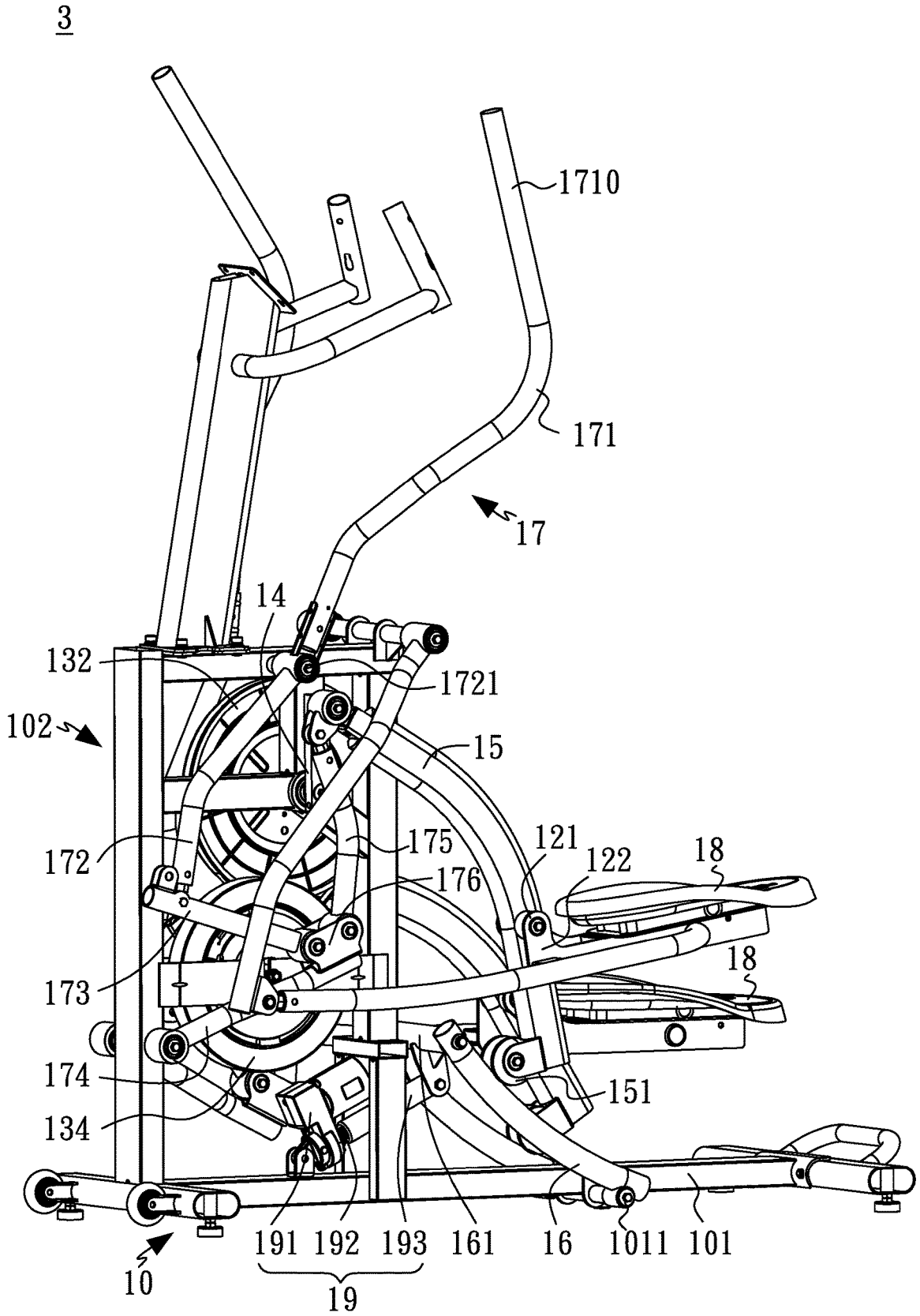
FIG. 5 is a perspective view showing an exercise device according to a third embodiment of the present invention.
Figure 6:
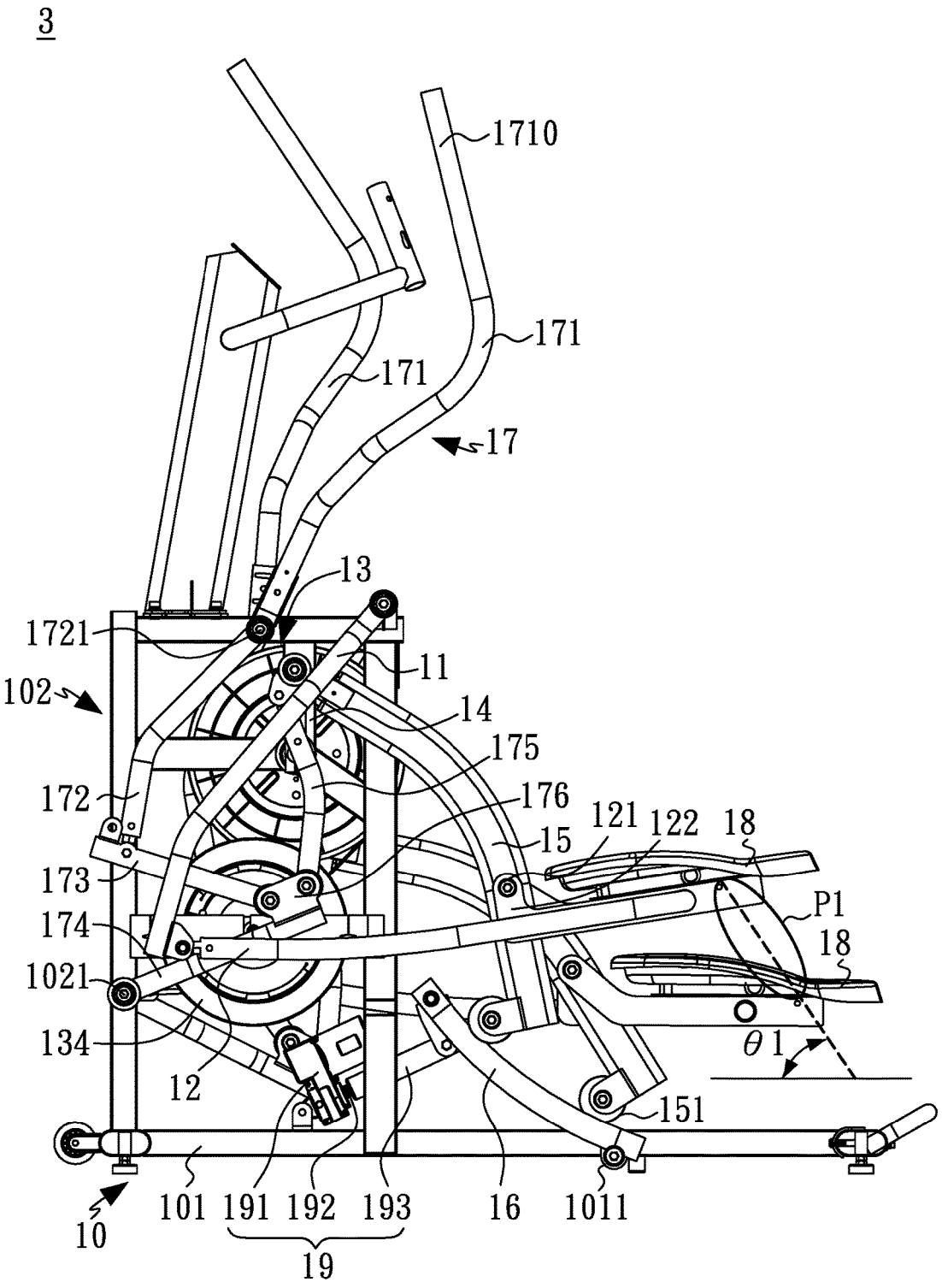
FIG. 6 is a side view showing the exercise device according to the third embodiment of the present invention.
Figure 7:
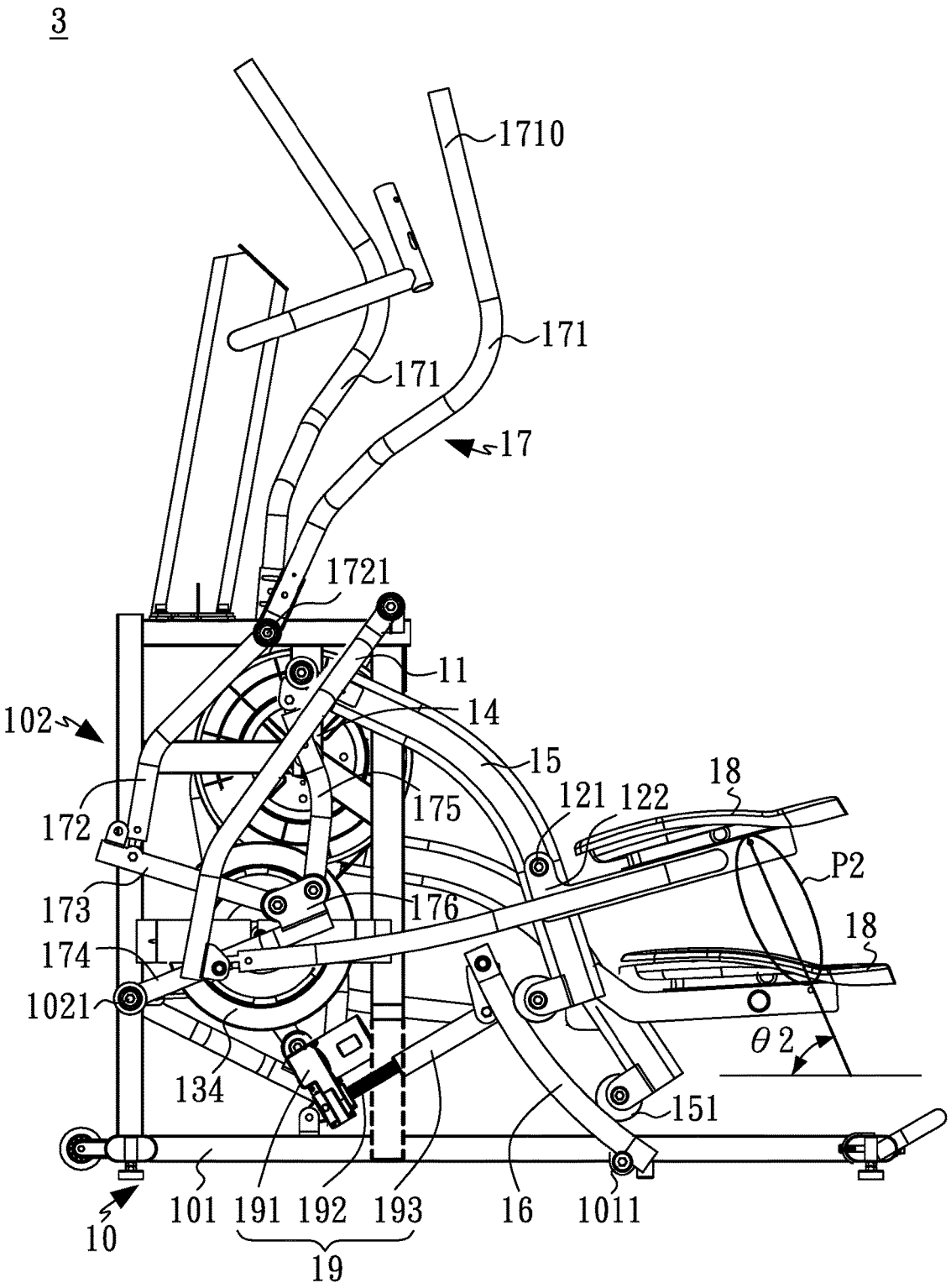
FIG. 7 is a side view showing the exercise device according to the third embodiment of the present invention.

FIG. 5 is a perspective view and FIGS. 6 and 7 are side views showing an exercise device 3 according to a third and also a preferred embodiment of the present invention. The exercise device 3 differs from the exercise device 1 in that the exercise device 3 further includes an angle-adjustment device 19.

Referring to FIGS. 5, 6, and 7, an end of the angle-adjustment device 19 couples to the base 101, and another end of the angle-adjustment device 19 moveably couples to the two limiting rods 16. The angle-adjusting device 19 may comprise, but is not limited to, a motor 191, a screw 192, and a tube 193. The motor 191 can drive the screw 192 to rotate, and the tube 193 has internal thread to engage with the screw 192. When the motor 191 drives the screw 192 to rotate in a counterclockwise or clockwise direction, the tube 193 is moved along the screw 192 in a direction toward the motor 191 or away from the motor 191. In addition, a horizontal linkage 161 may further be included, where an end of the tube 191 pivotally couples to the horizontal linkage 161, the first end of each of the two limiting rods 16 couples to the horizontal linkage 161, and the second end of each of the two limiting rods 16 pivotally couples to the base 101 via a pivot 1011.

Referring to FIGS. 5 and 6, when the motor 191 drives the screw 192 to rotate, the tube 193 is moved along the screw 192 in a direction toward the motor 191. At this state, the tube 193 drags the limiting rods 16 via the horizontal linkage 161, such that the angle between the limiting rod 16 and the horizontal plane is decreased, the angle θ1 between the major axis of the elliptical moving path P1 and the horizontal plane is a minimum angle, and the stride of the exercise device 3, i.e., the length of the major axis of the elliptical moving path P1 is a minimum stride. In this embodiment, the angle θ1 is about 43°, and the stride is about 29 cm.

Referring to FIGS. 5 and 7, when the motor 191 drives the screw 192 to rotate, the tube 193 is moved along the screw 192 in a direction away from the motor 191. At this state, the tube 193 pushes the limiting rods 16 via the horizontal linkage 161, such that the angle between the limiting rod 16 and the horizontal plane is increased, the angle θ2 between the major axis of the elliptical moving path P2 and the horizontal plane is a maximum angle, and the stride of the exercise device 3 of the elliptical moving path P2 is a maximum stride. In this embodiment, the angle θ2 is about 59°, and the stride is about 36 cm. The user may control the angle-adjustment device 19 via the operating interface to obtain a suitable inclined angle and stride. The exercise device 3 can provide a moving path that is optimum for the user. The other details of the exercise device 3 are the same as the exercise device 1 and therefore are omitted for simplicity.

Figure 8:
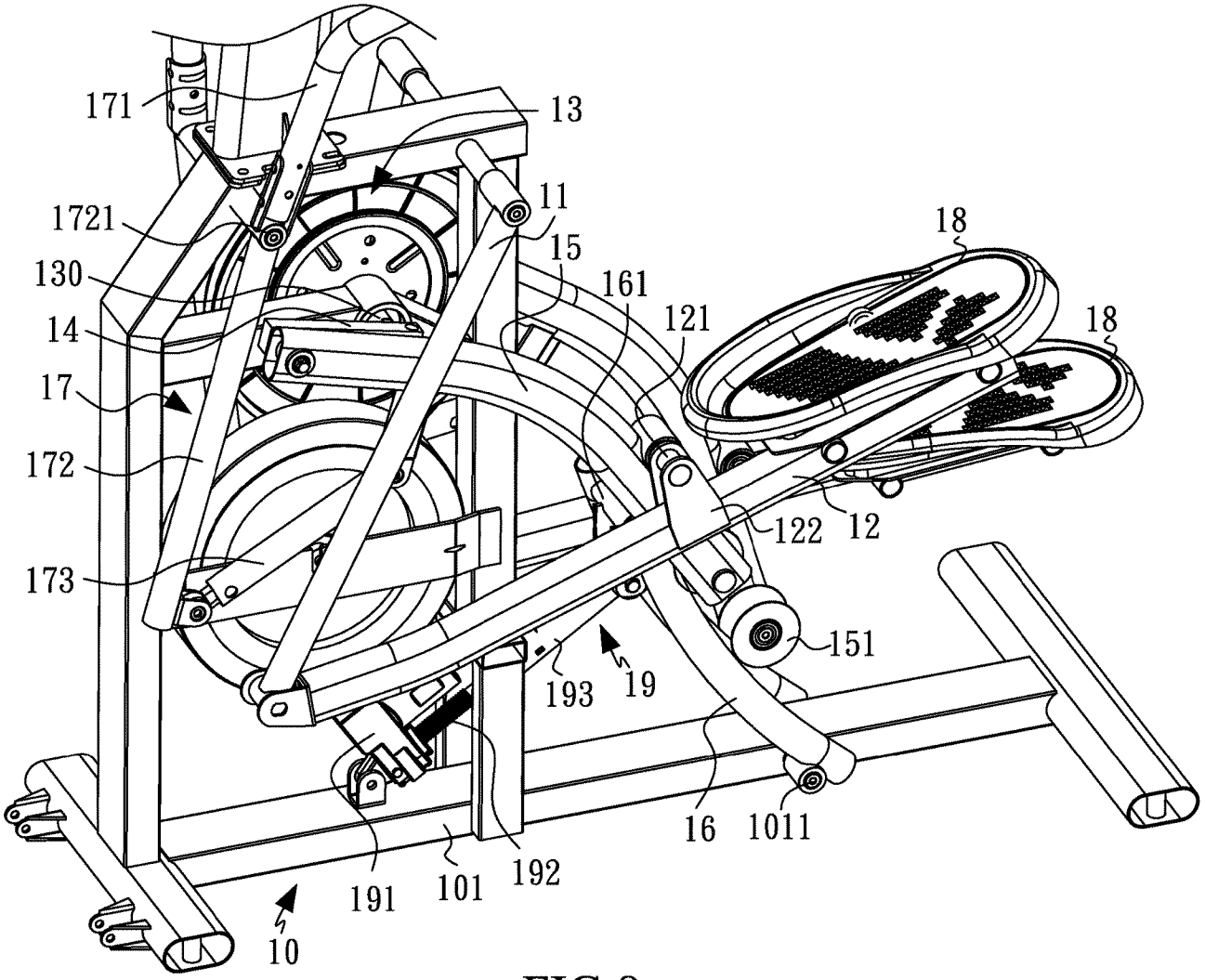
FIG. 8 is a partially perspective view showing an exercise device according to a fourth embodiment of the present invention.
Figure 9:
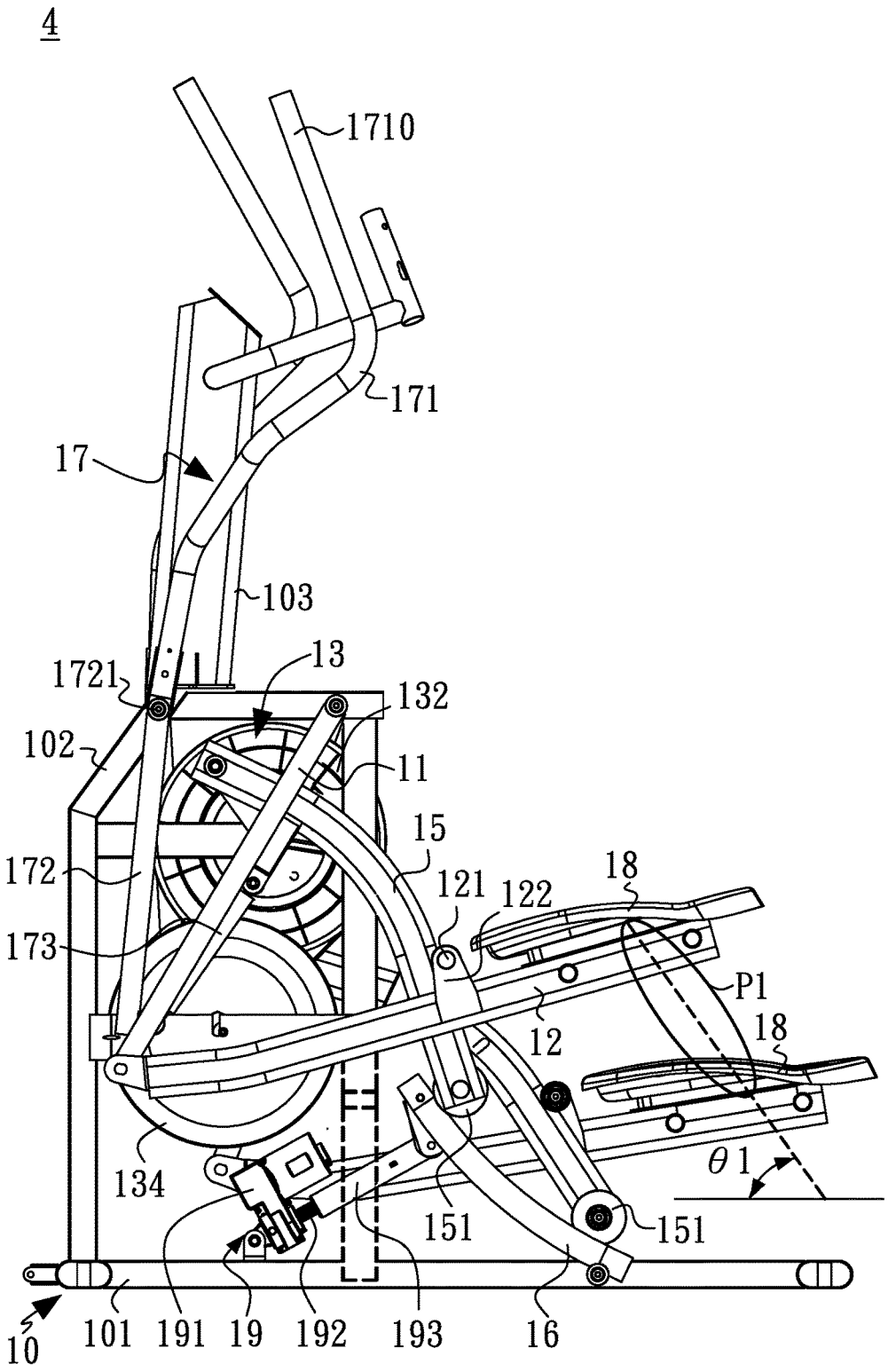
FIG. 9 is a side view showing the exercise device according to the fourth embodiment of the present invention.
Figure 10:
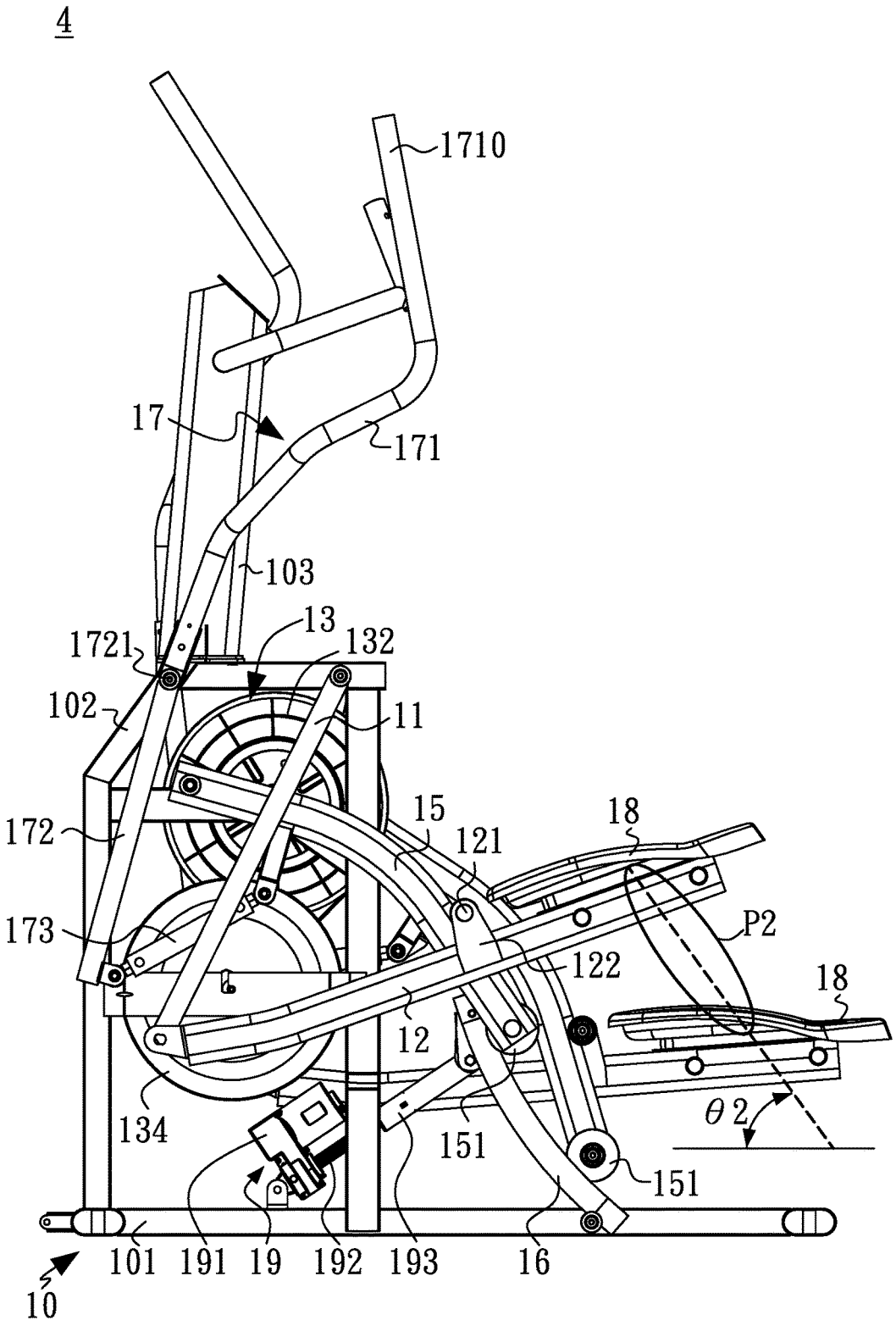
FIG. 10 is a side view showing the exercise device according to the fourth embodiment of the present invention.

FIG. 8 is a partially perspective view and FIGS. 9 and 10 are side views showing an exercise device 4 according to a fourth embodiment of the present invention. The exercise device 4 differs from the exercise device 3 in that each upper linking assembly 17 of the exercise device 4 merely includes the upper rod 171, the first linking arm 172, and the second linking arm 173, and omits the third linking arm 174, the fourth linking arm 175, and the transporting member 176. In addition, the first end of the second linking arm 173 pivotally couples to the second end of the first linking arm 172, and the second end of the second linking arm 173 pivotally couples to a portion between the first end and the second end of one corresponding link rod 15, e.g., coupling to the front one-third portion of the corresponding link rod 15.

Referring to FIGS. 8 and 9, when the motor 191 drives the screw 192 to rotate, the tube 193 is moved along the screw 192 in a direction toward the motor 191. At this state, the tube 193 drags the limiting rods 16 via the horizontal linkage 161, such that the angle between the limiting rod 16 and the horizontal plane is decreased, the angle θ1 between the major axis of the elliptical moving path P1 and the horizontal plane is a minimum angle, and the stride of the exercise device 4, i.e., the length of the major axis of the elliptical moving path P1 is a minimum stride. In this embodiment, the angle θ1 is about 43°, and the stride is about 29 cm.

Referring to FIGS. 8 and 10, when the motor 191 drives the screw 192 to rotate, the tube 193 is moved along the screw 192 in a direction away from the motor 191. At this state, the tube 193 pushes the limiting rods 16 via the horizontal linkage 161, such that the angle between the limiting rod 16 and the horizontal plane is increased, the angle θ2 between the major axis of the elliptical moving path P2 and the horizontal plane is a maximum angle, and the stride of the exercise device 4 of the elliptical moving path P2 is a maximum stride. In this embodiment, the angle θ2 is about 59°, and the stride is about 36 cm. The user may control the angle-adjustment device 19 via the operating interface to obtain a suitable inclined angle and stride. The other details of the exercise device 4 are the same as the exercise device 1 and therefore are omitted for simplicity.

Figure 11:
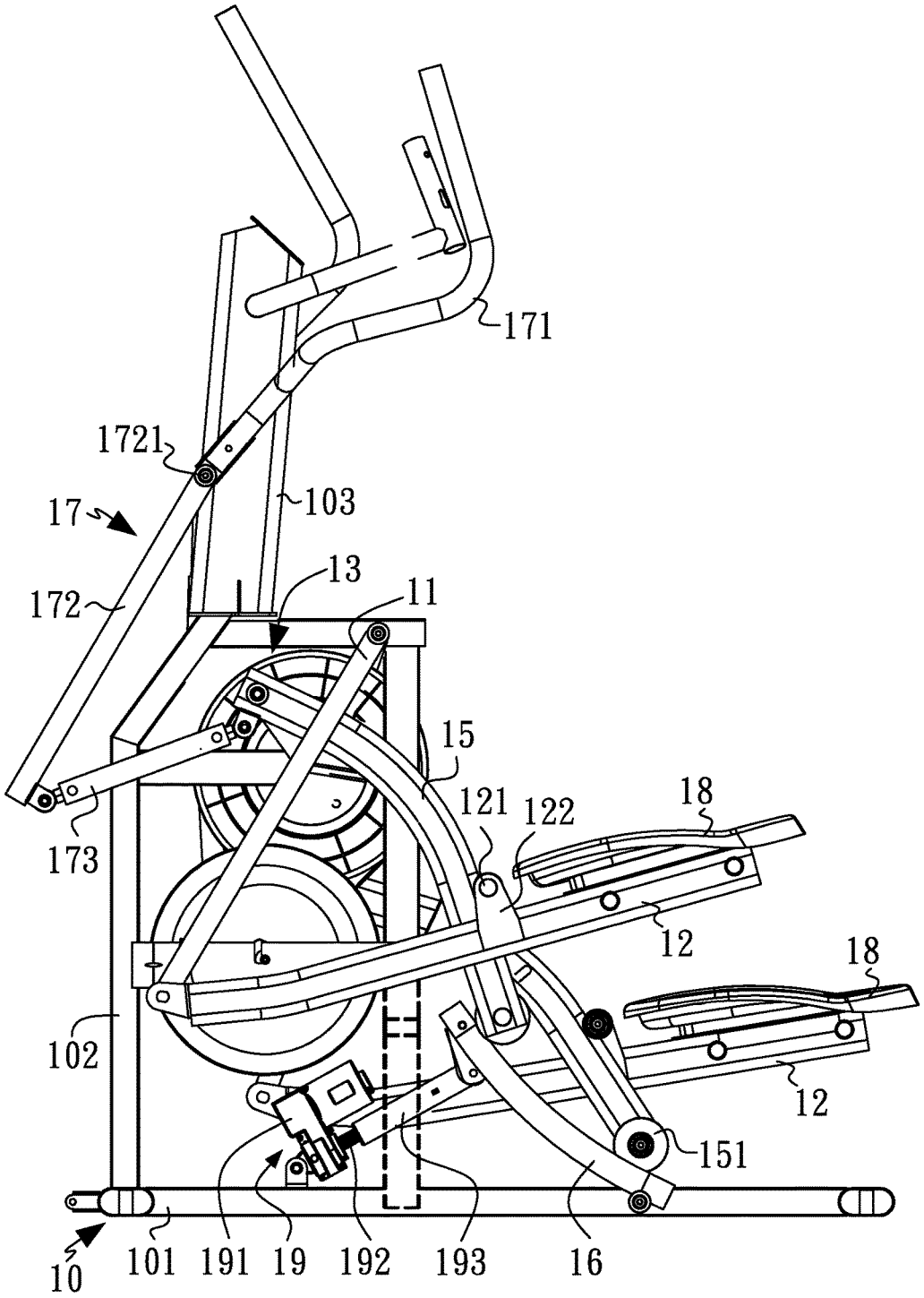
FIG. 11 is a side view showing an exercise device according to the fifth embodiment of the present invention.
Figure 12:
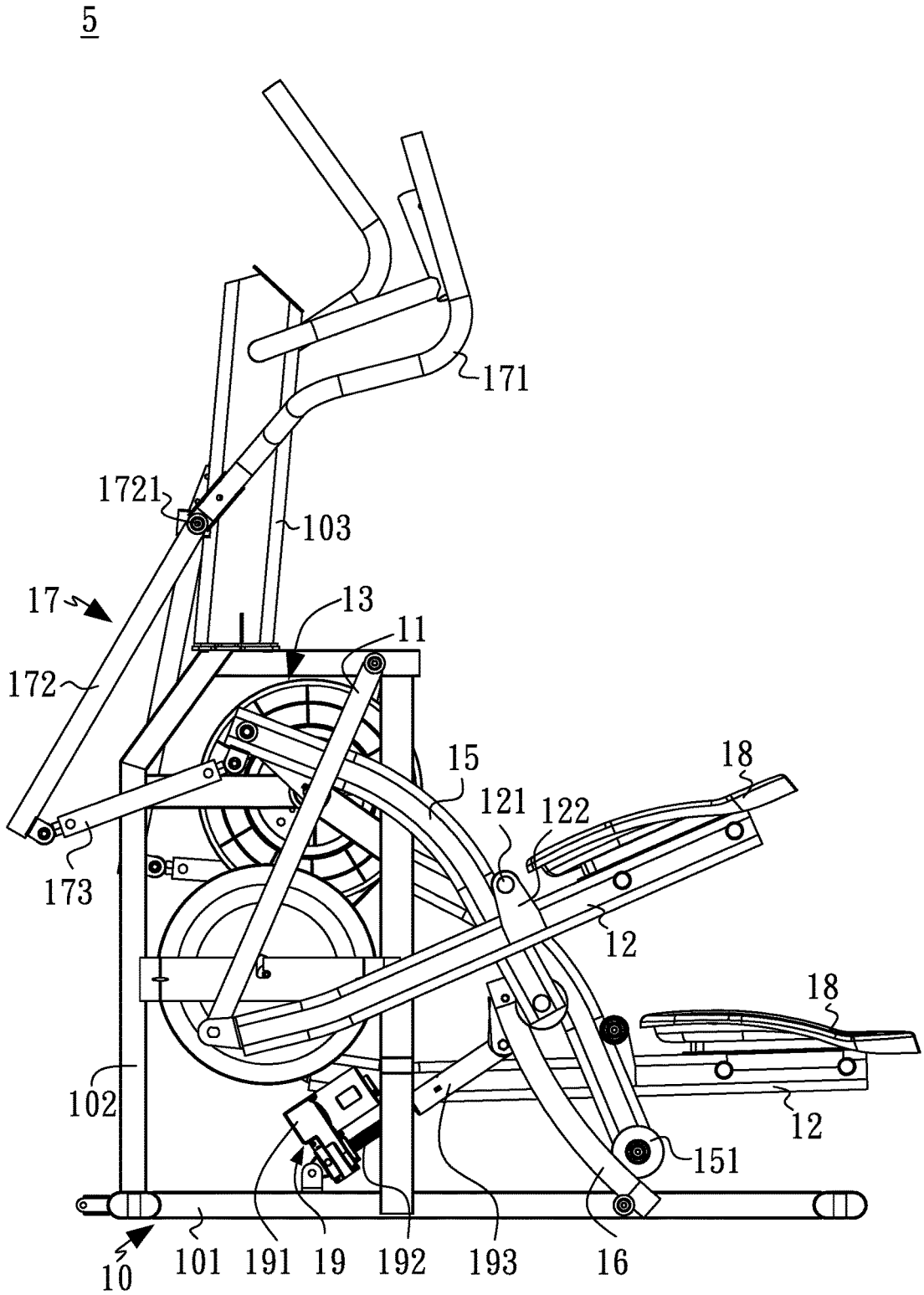
FIG. 12 is a side view showing the exercise device according to the fifth embodiment of the present invention.

FIGS. 11 and 12 are side views showing an exercise device 5 according to a fifth embodiment of the present invention. Most of features of the exercise device 5 are the same as features of the exercise device 4, and the difference between them is the coupling between the upper linking assembly 17 and the link rod 15. In this embodiment, the second end of the second linking arm 173 pivotally couples to the first end of one corresponding link rod 15. In addition, the first end of the first linking arm 172 pivotally couples to the post 103 via a pivot 1721. The other details of the exercise device 5 are the same as the exercise device 4 and therefore are omitted for simplicity. FIG. 11 shows that the motor 191 drives the screw 192 to move the tube 193 along the screw 192 in a direction toward the motor 191. FIG. 12 shows that the motor 191 drives the screw 192 to move the tube 193 along the screw 192 in a direction away from the motor 191. The above-mentioned features of the exercise device 5 can also be applied to any one of the other embodiments of the present invention.

Figure 13:
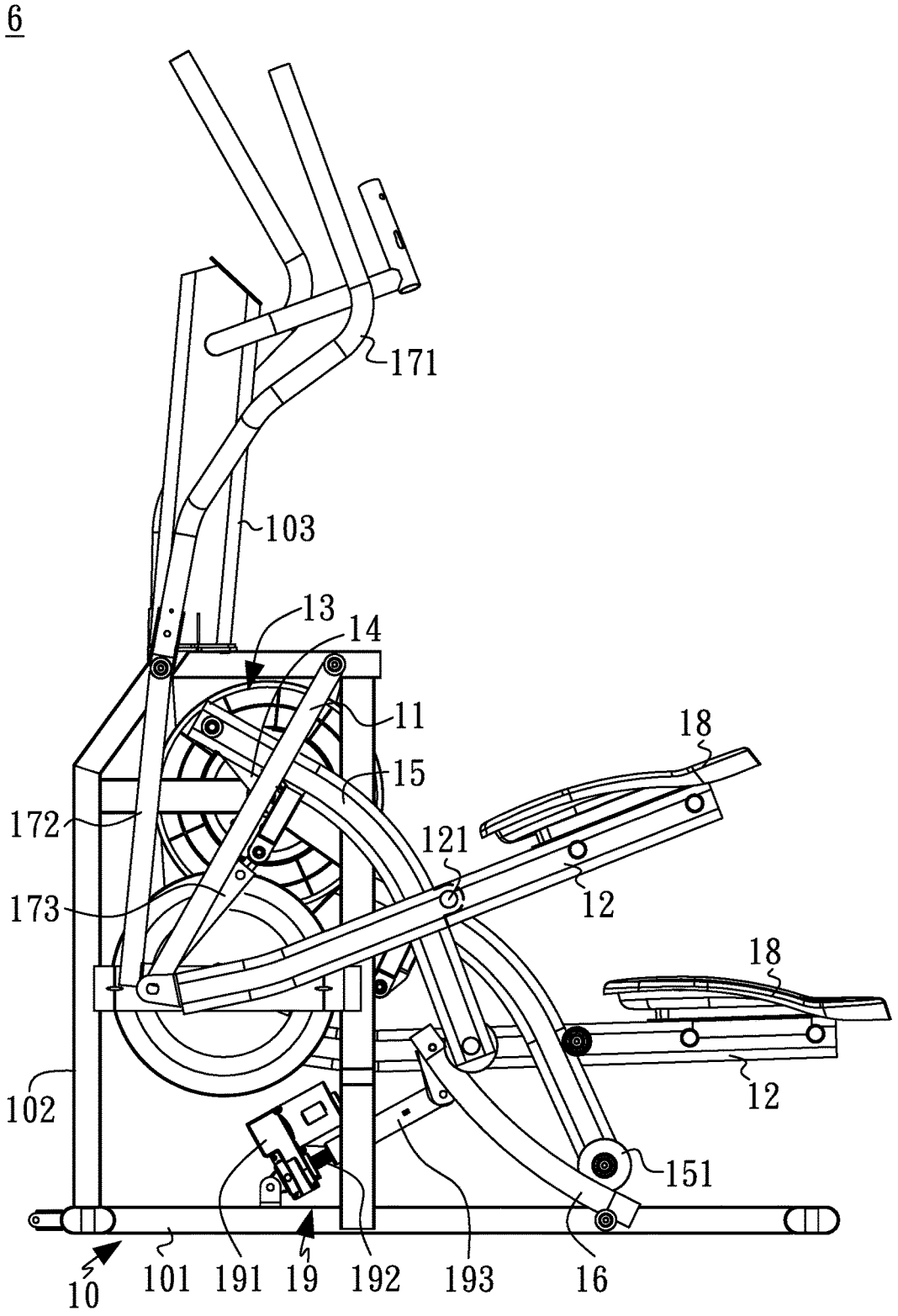
FIG. 13 is a side view showing an exercise device according to a sixth embodiment of the present invention.
Figure 14:
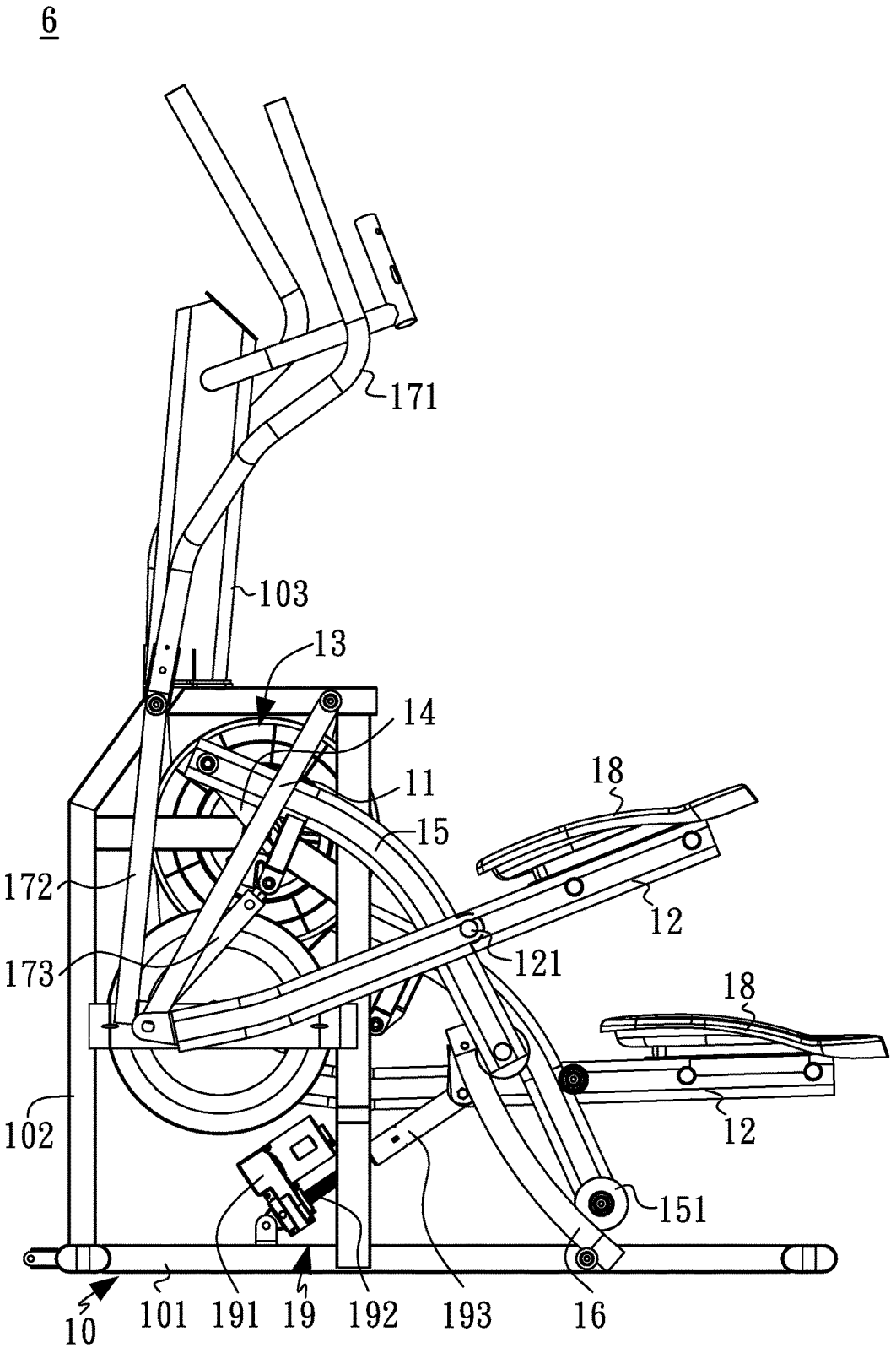
FIG. 14 is a side view showing the exercise device according to the sixth embodiment of the present invention.

FIGS. 13 and 14 are side views showing an exercise device 6 according to a sixth embodiment of the present invention. Most of features of the exercise device 6 are the same as features of the exercise device 4, and the difference between them is the coupling between the second swing arm 12 and the link rod 15. In this embodiment, the second swing arm 12 couples to one corresponding link rod 15 via a pivot 121, so that the second swing arm 12 and the corresponding link rod 15 can rotate around the pivot 121. Comparing with the exercise device 4, the exercise device 6 does not include the connecting member 122 (FIG. 9), and the pivot 121 is at the second swing arm 12. Experimental results show that the connecting member 122 allows the operation of the pedals 18 smoother due to a wider portion at two ends of the elliptical moving path. The other details of the exercise device 6 are the same as the exercise device 4 and therefore are omitted for simplicity. The above-mentioned features of the exercise device 6 can also be applied to any one of the other embodiments of the present invention.

Figure 15:
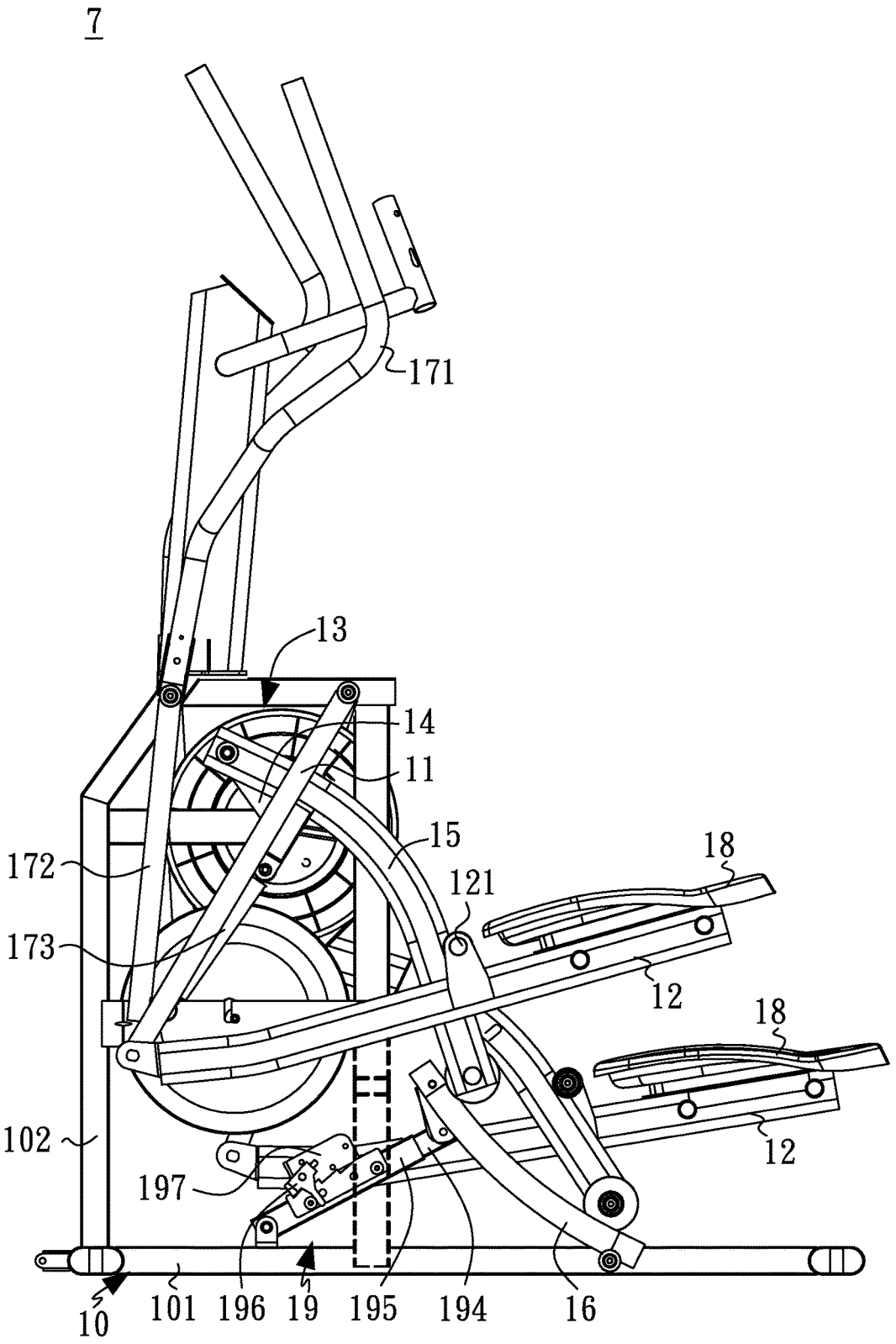
FIG. 15 is a side view showing the exercise device according to a seventh embodiment of the present invention.
Figure 16:
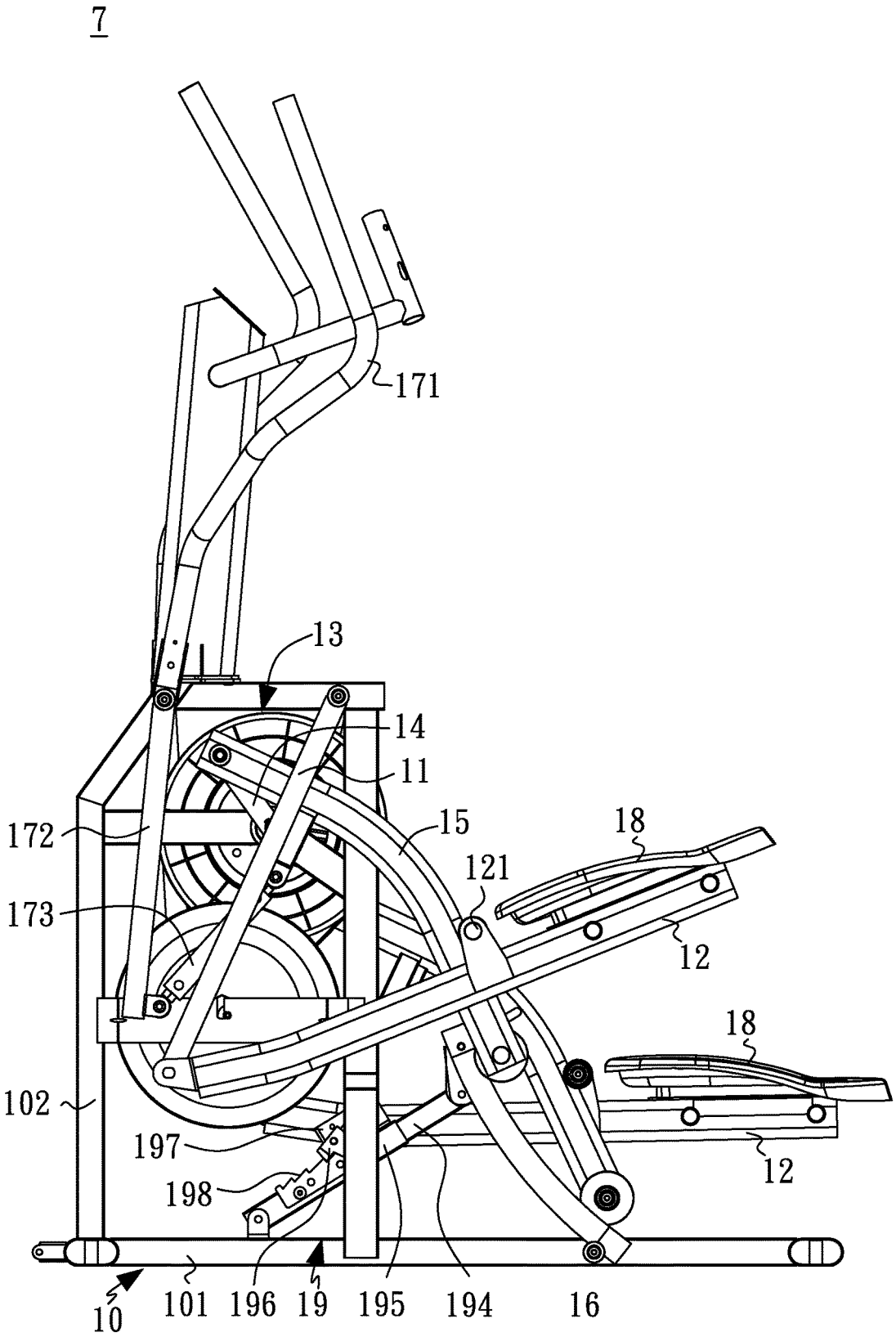
FIG. 16 is a side view showing the exercise device according to the seventh embodiment of the present invention.
Figure 17:
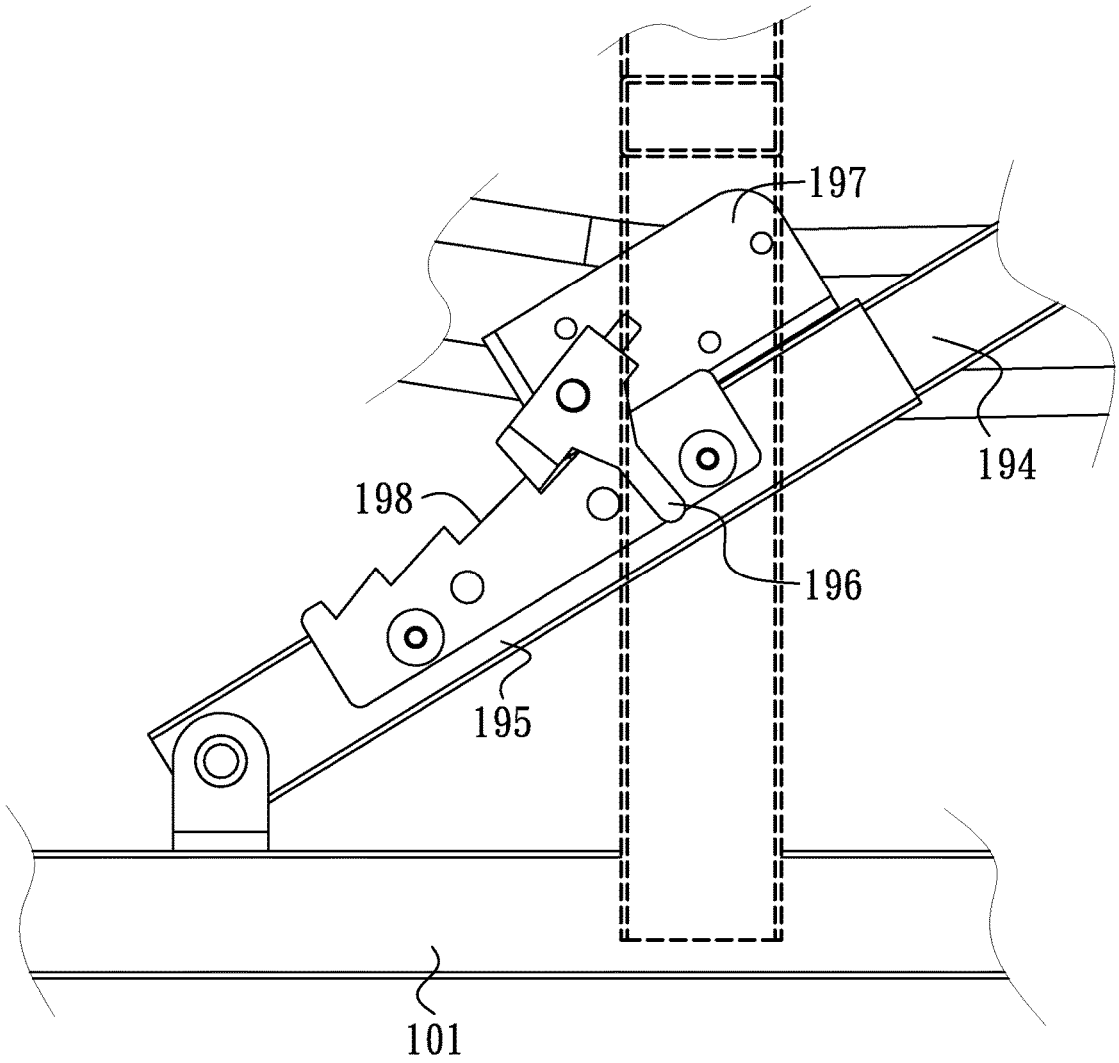
FIG. 17 is a partially enlarged view showing the exercise device according to the seventh embodiment of the present invention.
Figure 18:
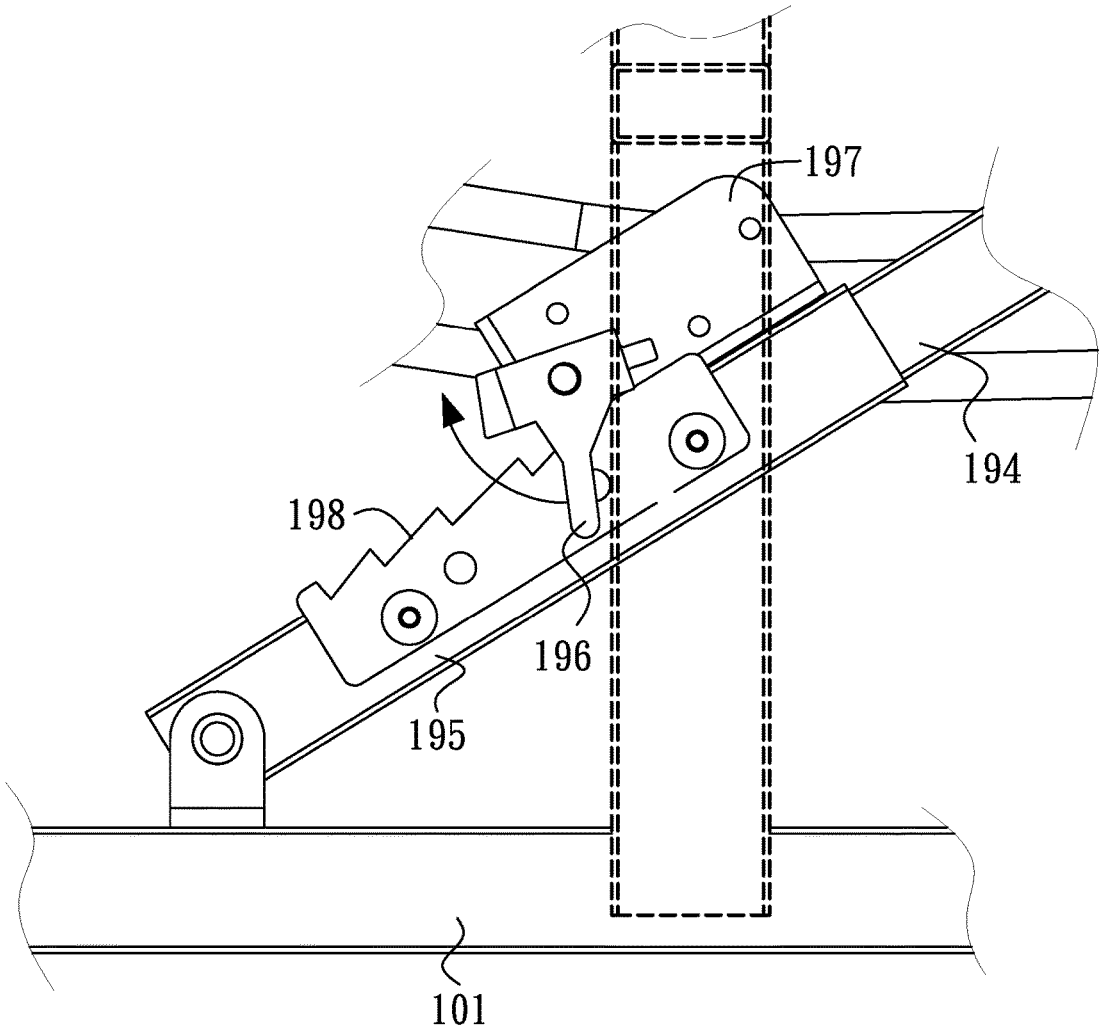
FIG. 18 is a partially enlarged view showing the exercise device according to the seventh embodiment of the present invention.

FIGS. 15 and 16 are side views and FIGS. 17 and 18 are partially enlarged views showing an exercise device 7 according to seventh embodiment of the present invention. n. Most of features of the exercise device 7 are the same as features of the exercise device 4, and the difference between them is the angle-adjustment device 19. In this embodiment, the angle-adjustment device 19 includes an inner tube 194, an outer tube 195, a controller 196, and a support 197. The inner tube 194 is arranged within the outer tube 195, where an end of the outer tube 195 pivotally couples to the base 101, and an end of the inner tube 194 movably couples to the first ends of the limiting rods 16 via the horizontal linkage 161 (FIG. 8). In addition, the controller 196 couples to the support 197 and the controller 196 can be manually placed into one of a plurality of positioning recesses 198 of the outer tube 195. In addition, the support 197 couples to the inner tube 194 and can drag the inner tube 194 moving within the outer tube 195. FIGS. 17 and 18 show the controller 196 being operated to move the controller 196 and the support 197. FIG. 15 show the controller 196 and the support 197 being moved to a positioning recess 198 near the base 101, and FIG. 16 show the controller 196 and the support 197 being moved to a positioning recess 198 far from the base 101.

Because the moving path P1/P2/P2 of the exercise devices 1/2/3/4/5/6/7 has no inflection point, the operation of the exercise devices 1/2/3/4/5/6/7 will be quite smooth. Compared with the conventional non-ergonomic moving path, the moving path P1/P2/P2 of the exercise devices 1/2/3/4/5/6/7 is ergonomic. In addition, the two pedals 18 of the exercise devices 1/2/3/4/5/6/7 can be moved when the crank 14 and the link rod 15 are overlapped, therefore the "dead point" deficiency of conventional steppers has been overcome.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a frame having a base and a supporting structure, wherein the base is arranged on a supporting plane or ground and the supporting structure is arranged on the base;

two first swing arms respectively arranged at a left side and a right side of the supporting structure, each first swing arm having a first end pivotally coupling with the supporting structure;

two second swing arms coupling with the two first swing arms, each first swing arm having a second end pivotally coupling with a first end of one corresponded second swing arm;

two pedals coupling with the two second swing arms, each second swing arm having a second end coupling with one corresponded pedal;

a resistance device being mounted on the supporting structure and having a driving wheel with an axle for providing a resistance;

two cranks respectively arranged at a left side and a right side of the resistance device, each crank having a first end coupling with the axle of the driving wheel;

two link rods coupling with the two cranks and the two second swing arms, each link rod pivotally coupling to one corresponding second swing arm via a pivot, each link rod having a first end to couple a second end of one corresponded crank;

two limiting rods movably coupling to the two link rods, each limiting rod having an end pivotally coupling with the base, each link rod having a second end with a roller to slide on one corresponding limiting rod; and two upper linking assemblies respectively arranged at a left side and a right side of the supporting structure, wherein each upper linking assembly comprises an upper rod, a first linking arm, and a second linking arm, and wherein a first end of the upper rod has a handle to be held by the user, a second end of the upper rod couples to the first linking arm, a first end of the first linking arm pivotally couples to the supporting structure via a pivot, a second end of the first linking arm pivotally couples to a first end of the second linking arm, and a second end of the second linking arm pivotally couples to the first end of one corresponding link rod or pivotally couples to a portion between the first end and the second end of one corresponding link rod;

whereby each pedal has an elliptical moving path.

2. The exercise device of claim 1, wherein an angle between a major axis of the elliptical moving path and a horizontal plane is greater than 40°.

3. The exercise device of claim 1, wherein each second swing arm further comprising a connecting member to couple with the corresponding link rod, and the pivot coupling each link rod to a corresponding second swing arm is at an upper end of the connecting member, so that a distance is between the pivot and the second swing arm.

4. The exercise device of claim 1, further comprising an angle-adjustment device to movably couple a first end of each of the two limiting rods, and a second end of each of the two limiting rods pivotally couples to the base.

5. The exercise device of claim 4, wherein the angle-adjustment device comprises a motor, a screw, and a tube, the tube has internal thread to engage with the screw, and the motor can drive the screw to rotate, so that the tube is moved along the screw in a direction toward the motor or away from the motor.

6. The exercise device of claim 5, wherein an end of the motor pivotally couples to the base, an end of the tube couples to a horizontal linkage, and the first end of each of the two limiting rods couples to the horizontal linkage.

7. The exercise device of claim 4, wherein the angle-adjustment device is a manually controlled device and comprises an inner tube, an outer tube, a controller, and a support, and wherein the inner tube is arranged within the outer tube, an end of the outer tube pivotally couples to the base, an end of the inner tube movably couples to the first end of each of the two limiting rods, the controller couples to the support and the controller can be manually placed into one of a plurality of positioning recesses of the outer tube, and the support couples to the inner tube and can drag the inner tube to move within the outer tube.

8. The exercise device of claim 1, wherein each limiting rod is arc-shaped with a center oriented toward a portion of the user.

9. An exercise device, comprising:

a frame having a base and a supporting structure, wherein the base is arranged on a supporting plane or ground and the supporting structure is arranged on the base;

two first swing arms respectively arranged at a left side and a right side of the supporting structure, each first swing arm having a first end pivotally coupling with the supporting structure;

two second swing arms coupling with the two first swing arms, each first swing arm having a second end pivotally coupling with a first end of one corresponded second swing arm;

two pedals coupling with the two second swing arms, each second swing arm having a second end coupling with one corresponded pedal;

a resistance device being mounted on the supporting structure and having a driving wheel with an axle for providing a resistance;

two cranks respectively arranged at a left side and a right side of the resistance device, each crank having a first end coupling with the axle of the driving wheel;

two link rods coupling with the two cranks and the two second swing arms, each link rod pivotally coupling to one corresponding second swing arm via a pivot, each link rod having a first end to couple a second end of one corresponded crank;

two limiting rods movably coupling to the two link rods, each limiting rod having an end pivotally coupling with the base, each link rod having a second end with a roller to slide on one corresponding limiting rod; and two upper linking assemblies respectively arranged at a left side and a right side of the supporting structure, wherein each upper linking assembly comprises an upper rod, a first linking arm, a second linking arm, a third linking arm, a fourth linking arm, and a transporting member, and wherein a first end of the upper rod includes a handle to be held by the user, a second end of the upper rod couples with the first linking arm, a first end of the first linking arm pivotally couples to the supporting structure via a pivot, a second end of the first linking arm pivotally couples to a first end of the second linking arm, a second end of the second linking arm pivotally couples to a first end of the transporting member, a first end of the third linking arm pivotally couples to the supporting structure via a pivot, a second end of the third linking arm couples to a side of the transporting member, a first end of the fourth linking arm pivotally couples to a second end of the transporting member, and a second end of the fourth linking arm pivotally couples to the first end of one corresponding link rod;

whereby each pedal has an elliptical moving path.

10. The exercise device of claim 9, wherein an angle between a major axis of the elliptical moving path and a horizontal plane is greater than 40°.

11. The exercise device of claim 9, further comprising an angle-adjustment device to movably couple a first end of each of the two limiting rods, and a second end of each of the two limiting rods pivotally couples to the base.

12. The exercise device of claim 11, wherein the angle-adjustment device comprises a motor, a screw, and a tube, the tube has internal thread to engage with the screw, and the motor can drive the screw to rotate, so that the tube is moved along the screw in a direction toward the motor or away from the motor.

13. The exercise device of claim 12, wherein an end of the motor pivotally couples to the base, an end of the tube couples to a horizontal linkage, and the first end of each of the two limiting rods couples to the horizontal linkage.

* * * * *